United States Patent [19]

Parker

[11] 4,027,560

[45] June 7, 1977

[54] POWER WRENCHES WITH TWO POINT REACTION MEANS

[75] Inventor: Kenneth Wade Parker, Houston, Tex.

[73] Assignee: N-S-W Corporation, Houston, Tex.

[22] Filed: Sept. 15, 1975

[21] Appl. No.: 613,394

Related U.S. Application Data

[63] Continuation of Ser. No. 506,915, Sept. 17, 1974, abandoned.

[52] U.S. Cl. ..... 81/57.39

[51] Int. Cl.[2] ..... B25B 13/46

[58] Field of Search ..... 81/57.39, 57.44, 54, 81/55, 57.16, 57.19, 57.22, 57.34, 57.36, 57.46

[56] References Cited

UNITED STATES PATENTS

| | | | |
|---|---|---|---|
| 2,972,918 | 2/1961 | Huft et al. | 81/57.44 X |
| 3,706,244 | 12/1972 | Wilmeth | 81/57.39 X |
| 3,745,858 | 7/1973 | Biach | 81/57.39 |

FOREIGN PATENTS OR APPLICATIONS

| | | | |
|---|---|---|---|
| 141,106 | 3/1960 | U.S.S.R. | 81/57.39 |

*Primary Examiner*—James L. Jones, Jr.
*Attorney, Agent, or Firm*—Michael P. Breston

[57] ABSTRACT

The power tool is especially adapted for driving one of a plurality of adjacently spaced members. The tool comprises a wrench adapter to be positioned over one of the members. A wrench extends laterally from the wrench adapter. An anchor assembly is coupled to the wrench adapter. The anchor assembly comprises an anchor ring rotatably mounted on the wrench adapter, an anchor adapter typically positionable over another of the members, and a reaction beam having one end coupled to the anchor ring and another end coupled to the anchor adapter.

6 Claims, 7 Drawing Figures

POWER WRENCHES WITH TWO POINT REACTION MEANS

REFERENCE TO RELATED APPLICATION

This application is a continuation of my copending application Ser. No. 506,915, filed on Sept. 17, 1974, now abandoned, and assigned to the same assignee.

FIELD OF THE INVENTION a. This invention generally relates to power wrenches with reaction means.

b. More particularly, this invention relates to power wrenches with two point reaction means especially adapted for flanged connections.

BACKGROUND OF THE INVENTION

Power wrenches for threaded members such as nuts and bolts aree described in U.S. Pat. Nos. 3,706,244 and 2,972,918. The patented tools are especially adapted for flangees whose threaded connectors are arranged in a circular pattern. There is a need for power wrenches which are readily adaptable for use on connectors arranged in a straight line or in non-circular patterns. The power wrench actuator is usually a fluid-operated cylinder having a rod which engages the wrench arm at a substantially right angle. By limiting the rotation of the wrench arm to a small angle in response to a full stroke of the push rod, and by making the right angle to become established at the push rod's mid-stroke, the torque can be fairly accurately measured by measuring only the applied pressure in the cylinder.

When a tool is designed for a specific connector pattern, the desired right angle can be built into the tool. However, any subsequent adjustments, which may be required to position the tool's reaction members, will most likely change this right angle by an angular amount which is not easy to measure.

The consequences of working with an angle which varies from a right angle are twofold; maximum torque is not obtained per unit of pressure applied to the hydraulic cylinder, and torque measurements cannot be sufficiently accurately made by simply measuring the pressure in the fluid-operated cylinder. There is therefore a need for power wrenches which allow adjustments to the positions of their reaction members without disturbing the desired right angle relationship between the push rod and the wrench arm.

The above-mentioned patented tools produce reaction stresses, which are absorbed by the structures supporting the reaction members. There is a need for power wrenches which can internally absorb most of their self-generated reaction stresses.

Accordingly, it is a broad object of the present invention to provide new and improved power wrenches which are versatile, which easily adapt themselves for use on irregular connector patterns, which internally absorb most of the reaction stresses, which have a built-in right angle relationship that is not disturbed when making reaction set-up adjustments, and which can rotate members such as threaded connectors, the access to which is partially obstructed.

SUMMARY OF THE INVENTION

The power wrenches of the present invention include a wrench adapter for positioning over the connector desired to be rotated. The rotated connector forms the first reaction point. A wrench arm extends laterally from the wrench adapter. An anchor adapter is positioned over an adjacent connector which forms the second reaction point. A reaction beam has one of its ends rotatably mounted on the wrench adapter. A wrench actuator is mounted on the reaction beam for exerting a force on the wrench arm. The actuator has a push rod which is coupled to the wrench arm.

In one embodiment of this invention, the anchor adapter is slidably connected, while in another embodiment it is pivotally connected to the reaction beam.

In the preferred embodiments the wrench arm forms a wrench head which defines at the free end thereof a plurality of angularly spaced-apart notches adapted to movably receive a reciprocating member of the wrench actuator.

Figure 1:
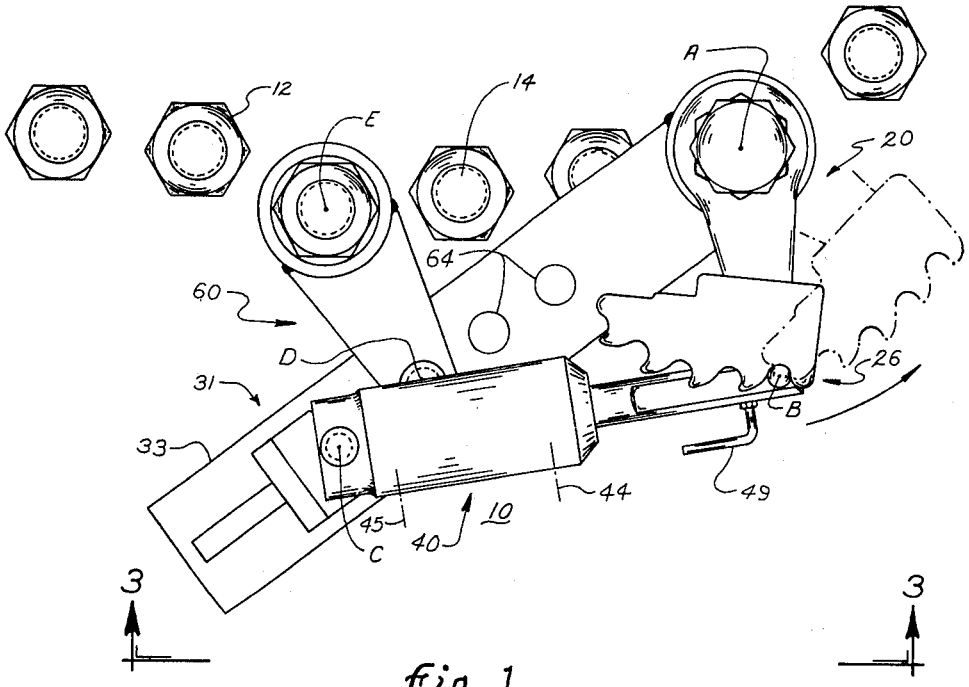
FIG. 1 is a plan view of one embodiment of a power wrench of this invention shown as being positioned for loosening a threaded connector.
Figure 2:
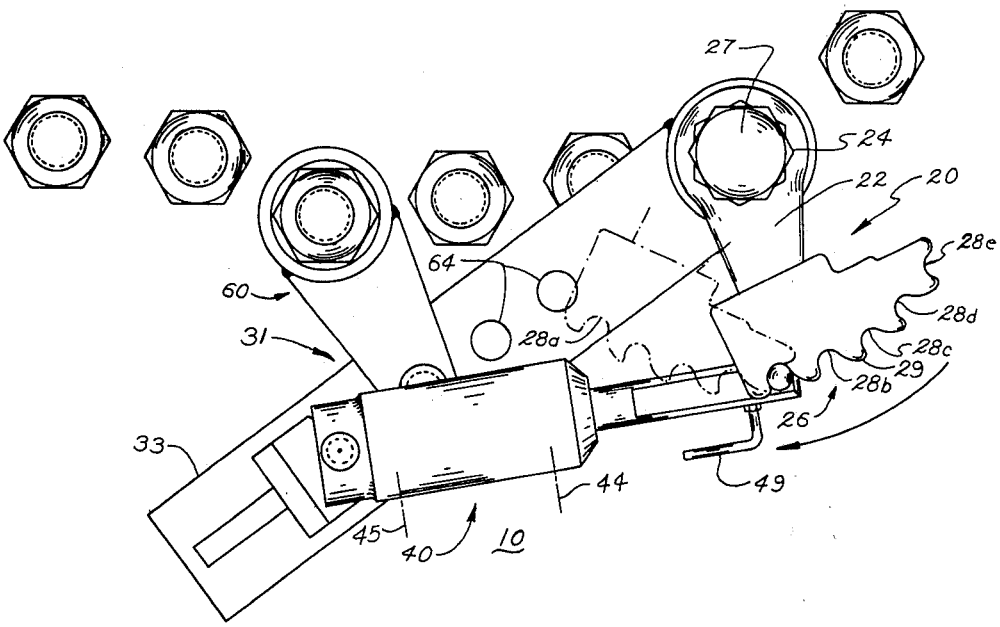
FIG. 2 is a plane view of the tool of FIG. 1 shown positioned for tightening the threaded connector.
Figure 3:
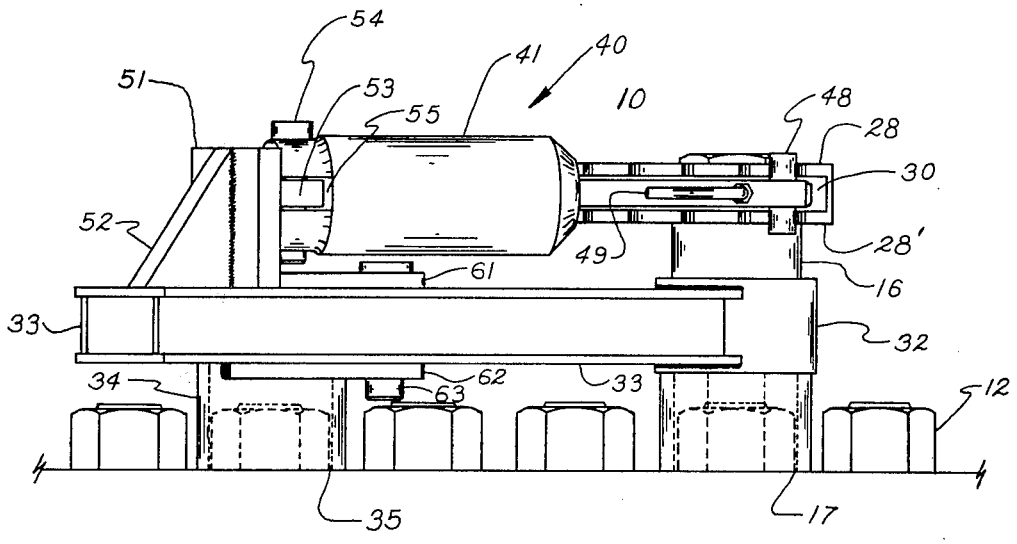
FIG. 3 is a view in elevation of the tool shown in FIG. 1.
Figure 7:
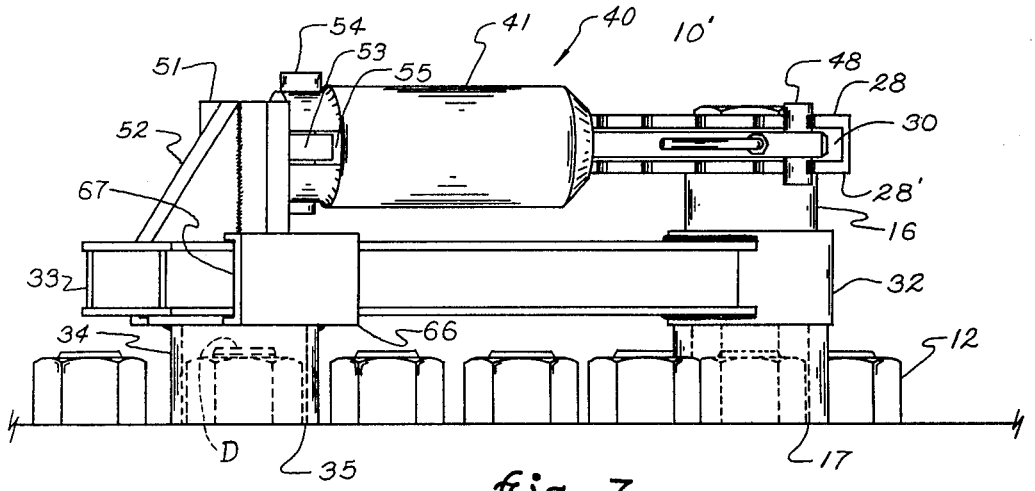
FIG. 7 is a view in elevation of the tool shown in FIG. 5.
Figure 5:
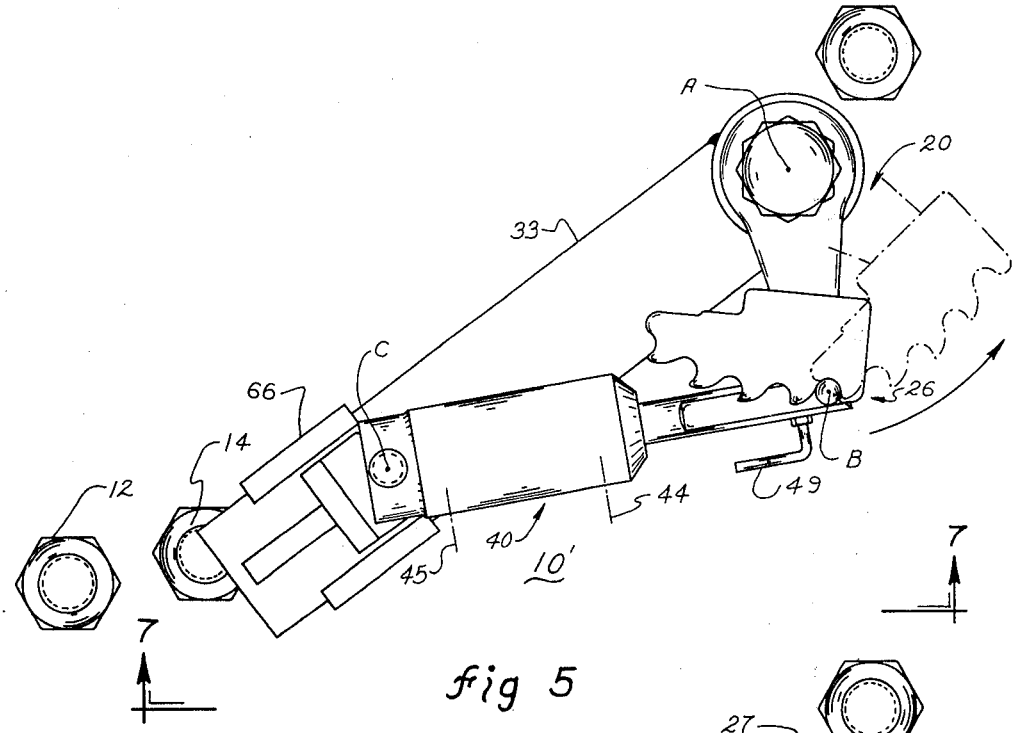
FIG. 5 is a plan view of another embodiment of the tool of this invention having a slidable anchor adapter and being positioned for loosening one of the threaded connectors.
Figure 6:
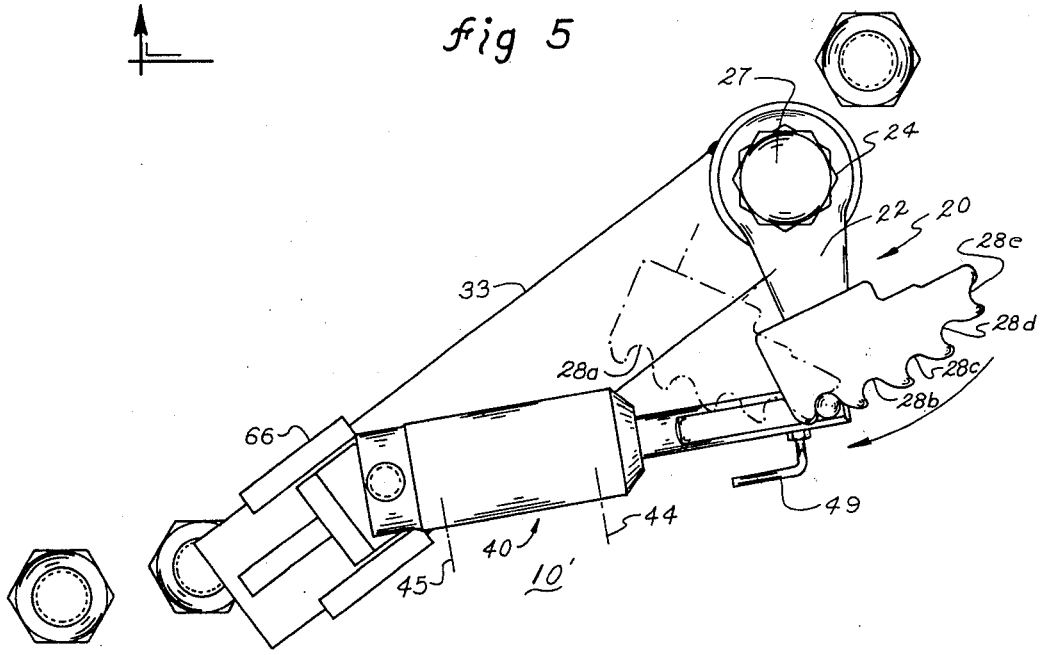
FIG. 6 is a plan view of the tool of FIG. 5 shown positioned for tightening one of the threaded connectors.

The embodiment of the tool shown in FIGS. 1–3 is generally designated as 10, and the modified embodiment shown in FIGS. 5–7 is generally designated as 10'. Each tool is shown as being positioneed over an irregular pattern of nuts 12 threadably connected to bolts 14. To rotate a particular nut, there is provided a cylindrical wrench adapter 16 (FIG. 3). In one embodiment, adapter 16 has a socket 17. The length of wrench adapter 16 will depend on the structure containing the threaded connectors and on the kind of obstacles surrounding them. The entire power tool 10 is thus elevated from the plane containing the threaded connectors.

To rotate wrench adapter 16, there is provided a wrench generally designated as 20, having an arm 22. One end of arm 22 has a socket 24 and the other end has a head 26. Socket 24 operatively engages the male hex pin 27 of the wrench adapter 16. Head 26 preferably has two plates 28, 28' (FIG.3) which form therebetween a channel 30 of sufficient width to allow the movement therein of a force-producing member. Each outward end of plates 28, 28' is provided with notches **28*a–e* which lie in a common plane and are generally arranged in a circular pattern relative to the axis of rotation of the wrench adapter 16. The ridges 29 of notches 28 are rounded and somewhat inclined to allow the application of force thereto by a cross-pin 48** received in the notches, as will be subsequently described.

Since the application of a pushing or pulling force on the wrench head 26 is accompanied by reaction stresses which may be in tension, compression, or both, there is provided an anchor reaction assembly, generally designated as 31. The reaction assembly provides a two-point structure and serves as a support for the power means used to produce the force on the wrench head 26.

The preferred reaction assembly 31 comprises a front anchor ring 32 (FIG. 3) which loosely fits around the wrench adapter 16 to allow relative rotation therebetween. Thus the nut 12 being rotated serves as a first reaction point. Extending from ring 32 is a reaction beam 33 which can rest on an adjacent anchor point. This is the second reaction point. Preferably, beam 33 is movably connected at its rear end to an anchor adapter 34 having a socket 35 which loosely fits over an adjacent nut 12 which serves as the desired second reaction point.

Figure 4:
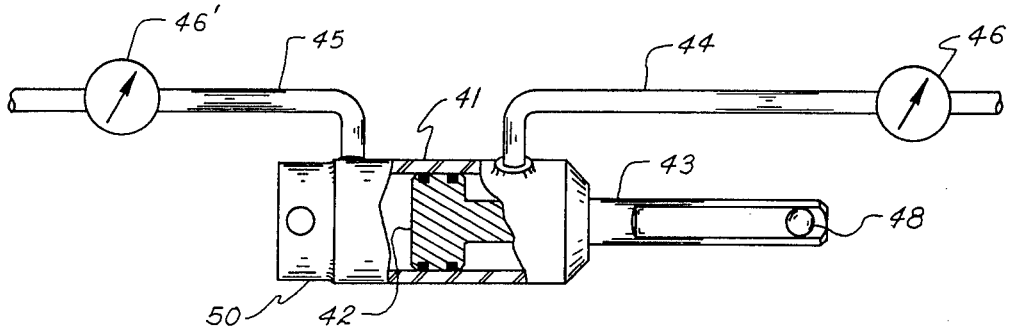
FIG. 4 is a schematic showing of the fluid-operated actuator.

Mounted on top of the reaction beam 33 is a wrench actuator generally designated as 40. The actuator may be any power means, although the preferred embodiments of this invention employ a fluid-operated cylinder 41 having a double-acting piston 42 (FIG. 4) from which extends outwardly a push rod 43 that fits inside channel 30 of the wrench head 26. The cylinder is controlled by two fluid lines 44, 45 each being adapted to alternatingly receive fluid pressure from a conventional fluid pressure source (not shown). The amount of pressure received can be varied to obtain the desired torque value. Suitable pressure gauges 46, 46' in lines 44, 45, respectively, measure the applied pressures to the piston 42. Meters 46, 46' are preferably calibrated in units of torque which is possible only if the proportionality factor between the applied pressure and the resultant torque is constant, i.e., only if the line of force is perpendicular to the moment arm.

The tip of the push rod 43 is provided with a transverse pin 48 having a diameter such that it can freely move into and out of the notches 28*a–e*. A handle 49 allows an operator to grab the push rod. Pin 48 transmits the force generated by the push rod to the ridge 29 which is engaged by pin 48. This force can be a pulling or pushing force.

The base 50 (FIG. 4) of the cylinder is pivotally mounted on an upright post 51 (FIG. 3) reinforced by a brace 52. Extending laterally from post 51 is a mounting eye 53 adapted to receive a pivot pin 54. Eye 53 loosely fits inside a cross-channel 55 in base 50.

The main difference between the two illustrated embodiments 10 and 10' of the subject invention lies in the manner of movably coupling the anchor adapter 34 to the reaction beam 33. In the power tool 10 illustrated in FIGS. 1–3, such coupling is achieved by a pivot arm, generally designated as 60, which consists of two plates 61, 62 (FIG. 3). A pivot pin 63 extends through one end of each plate and through a hole 64 in beam 33. A plurality of such longitudinally spaced-apart holes 64 can be provided in beam 33 to selectively accept pivot pin 63. The opposite ends of plates 61, 62 are fixedly secured to the anchor adapter 34 whose socket 35 loosely fits around and adjacent nut 12 to allow relative rotation therebetween.

In the embodiment of the power tool 10' illustrated in FIGS. 5–7, the anchor adapter 34 is slidably connected to the reaction beam 33 by a slide member 66 defining a U-channel 67 (FIG. 7) for slidably receiving the reaction beam 33 therethrough. Slide 66 forms integral part with anchor adapter 34 for simplicity of construction.

The operation of both power tools 10 and 10' will be better understood by designating certain critical points of the tools. Accordingly, points A-E respectively designate (FIGS. 1 and 5) the centers of wrench adapter 16, pin 48, pin 54, pin 63, and anchor adapter 34. In the power tool 10' distance DE is equal to zero and therefore point E is merged with point D.

OPERATION OF THE PREFERRED EMBODIMENTS

General Operation

In the power tool 10 (FIGS. 1–3), it is desired to produce a torque about point A by means of a force applied at B along the line of force BC. Points A, C and D are colinear and point E can rotate with radius DE about D to vary the distance AE, which is the distance between the first and second reaction points A and E. Rotation of point E allows power tool 10 to become positioned on a variable connector pattern. The fluid-operated cylinder 41, by means of a controllable fluid pressure, produces the desired force along line BC, which can be a pulling or pushing force. This force is applied at point B and is reacted mostly by an opposite force at C and by small reaction moments at A and E. The reaction forces are produced by reaction beam 33, whereas in known power wrenches this reaction force was entirely or mostly absorbed by the flange or other structure containing the threaded connectors.

The magnitude of the torque produced by the force applied by push rod 43 can be varied by varying the hydraulic pressure in line 45 (FIG. 4) applied against piston 42 in cylinder 41. The accuracy of the torque's measurements provided by guages 46, 46' is dependent upon the perpendicularity between the line of force BC and the moment arm AB. When power tool 10 is designed, the lengths of AC and BC are selected so that the triangle ABC will be a right triangle when the push rod 43 is at its mid-stroke. Since the deviation of the push rod from its mid-stroke position is kept purposely small by providing a plurality of notches 28, it can be assumed for all practical purposes that the triangle ABC remains a right triangle. In this fashion, maximum torque will be obtained per unit of applied force. Moreover, since the sides AB, BC, and AC of this triangle are fixed in length by the design of the tool, any adjustment of the second anchor point E will not disturb the desired perpendicularity between AB and BC.

Loosening Operation

Prior to starting the operation of power tool 10 (FIG. 1), the push rod is contracted and the wrench head 26 assumes the position as indicated by the solid lines. Pressure on line 45 starts the first cycle and causes an extension of the push rod which applies a force along the line of force BC which causes point B to rotate in a counterclockwise direction about point A with a radius AB. For each cycle, i.e., full extension of the push rod, the wrench head 26 will rotate conunterclockwise, say 12°, in the direction of the arrow. Pressure on line 44 will end the first cycle by retracting the push rod, causing pin 48 to move down from the first notch 28*a* to the second notch 28*b*. A second extension of the push rod will again cause the wrench head to rotate counterclockwise by 12° and a second retraction of the push rod will move pin 48 from the second notch 28*b* down to the third notch 28*c*. After five cycles pin 48 falls into the last notch 28*e* and then the wrench head 26 assumes the position as shown by the dotted lines in FIG. 1.

Thus, for five strokes ofthe piston the wrench head will have rotated counterclockwise by an angle of 60°. If the nut 12 is not then sufficiently loosened, wrench head 26 is manually returned to its original positon, as shown by the solid lines in FIG. 1, and a given number of cycles is repeated to obtain another angular rotation of nut 12. It is of course possible to rotate the wrench head by an angle less than 60°, say 36°, by only executing three full piston strokes instead of five. As thus far described, the power tool 10 has been working in its "push" mode.

Tightening Operation

In FIG. 2 the wrench head 26 is rotated 180° from its position shown in FIG. 1 and its initial position is indicated by the solid lines. To operate the power tool 10 in its "push" mode (FIG. 2), prior to starting a cycle of operation, pin 48 is made to lie in the first notch 28*a* and the push rod is fully extended. The first cycle of operation is started by applying pressure on line 44, thereby retracting the push rod and pulling on the wrench head 26. In response to the first full retraction of the push rod 43, wrench head 26 will rotate about 12° in a clockwise direction, as shown by the arrow. The first full extension of the push rod will cause pin 48 to move over into the next notch 28*b* thereby completing the first cycle. The second retraction of the push rod will cause the wrench head to again rotate by about 12° in a clockwise direction. After executing five such cycles, the wrench head will have rotated by about 60° in a clockwise direction. Thus, after five complete cycles of rotation the wrench head 26 will assume a position as shown by the dotted lines in FIG. 2. If nut 12 is not then sufficiently tightened, the process can be repeated, as before, to obtain additional discrete angular rotations of the wrench head 26.

Operation of the alternate embodiment 10′

Whereas in power tool 10 (FIG. 1), the second reaction point E is rotatable relative to point D (which can be movable on line AC), in power tool 10′ (FIG. 5) the second reaction point D is movable along line AC. Yet irrespective of such adjustments, the reaction beam 33 ensures that the line of force BC will remain substantially perpendicular to the moment arm AB for any position of the second anchor point D. In all other respects, the operation of power tool 10′ is the same as the operation of power tool 10.

ADVANTAGES OF THE PREFERRED EMBODIMENTS 10 & 10′

The power tools of this invention are not limited in their operation to predetermined threaded connector patterns. Adjustments of their two anchor points are permissible in the field without disturbing the desired perpendicularity between the line of force BC and the moment arm AB.

A full reaction point is a point which allows a pull and a push by the reaction means. A half-reaction point allows only a push by the reaction means. In the illustrated embodiments, the second reaction point D (FIG. 7) is a full reaction point, and, therefore, each tool can work in either a push or pull mode. The reaction forces and/or moments are absorbed principally by the reaction beam 33. A reaction beam can be easily replaced and at a fraction of the cost of repairing a damaged structure worked upon. With the tools of the present invention, it is possible to sufficiently space apart the wrench adapter and the anchor adapter, i.e., the two reaction points, so as to distribute the reaction forces over a larger area.

Because the front anchor ring 32 is mounted on the wrench adapter 16, wrench 20 can be mounted in such a fashion that it will not come apart from the reaction beam 33, thereby affording a unitary construction for the power tools 10 and 10′. A power tool of unitary construction is especially desirable for use underwater by drivers having a limited visibility.

The power tools of the present invention require no special set-ups since irrespective of the position of the second anchor point D or E, the desired perpendicularity between AB and BC will be maintained by the tool itself. Thus, the second anchor point can be variously positioned. If obstructions exist on one side of the threaded connectors 12, the wrench actuator 40 can be positioned on the opposite side of the reaction beam, as will be apparent to those skilled in the art, thereby allowing greater versatility in the use of these power tools.

What is claimed is:

1. A power tool for rotating one of a plurality of threaded members, said tool comprising:
   a. a wrench positionable over one threaded member for transmitting a torque thereto, said wrench having a head;
   b. a beam having a hollow sleeve loosely receiving said wrench therethrough for free relative rotation therebetween in the clockwise and counter-clockwise directions;
   c. a fluid-operated cylinder mounted over and being pivotally coupled to said beam, said cylinder having a reciprocating rod coupled to said head for transmitting a force thereto;
   d. an anchor anchorable only over another threaded member;
   e. means coupling said anchor to said beam; and
   f. said tool being anchorable solely to said one and said another threaded members for transmitting a torque to said one threaded member in both clockwise and counterclockwise directions, depending on the direction of the power stroke exerted by said rod.

2. A power tool for rotating one of a plurality of threaded members, said tool comprising:
   a. a wrench positionable over one threaded member for transmitting a torque thereto, said wrench having a head defining a plurality of angularly-spaced notches;
   b. a beam having a hollow sleeve loosely receiving said wrench therethrough for free relative rotation therebetween in the clockwise and counter-clockwise direction;
   c. a fluid-operated cylinder mounted over and being pivotally coupled to said beam, said cylinder having a reciprocating rod movable to successively engage said notches for successively transmitting a force to said wreench;
   d. an anchor anchorable only over another threaded member;
   e. means movably coupling said anchor to said beam to vary the distance between said one and said another threaded members; and
   f. said tool being anchorable solely to said one and said another threaded members for transmitting a torque to said one threaded member in both clockwise and counterclockwise directions, depending on the direction of the power stroke exerted by said rod.

3. A power tool for rotating one of a plurality of threaded members, said tool comprising:

a. a wrench adapter having a socket positionable over one threaded member for transmitting a torque thereto;

b. a wrench arm extending laterally from the wrench adapter, the outer end of said arm forming a wrench head having a plurality of angularly-spaced notches;

c. a beam having at one end a hollow sleeve loosely receiving said wrench adapter therethrough for free relative rotation therebetween in the clockwise and counterclockwise direction;

d. a fluid-operated cylinder mounted over and being pivotally coupled to said beam, said cylinder having a reciprocating rod successively engaging said notches for successively transmitting a force to said wrench arm;

e. an anchor having a socket positionable only over another threaded member;

f. means movably coupling said anchor to said beam to vary the distance between said one and said another threaded members; and g. said tool being anchorable solely to said one and said another threaded members for transmitting a torque to said one threaded member in both clockwise and counterclockwise directions, depending on the direction of the power stroke exerted by said rod.

4. The tool according to claim 3, wherein said anchor is slideably coupled to said beam.

5. The tool according to claim 3, wherein said anchor includes an arm pivotably connected to said beam.

6. The tool according to claim 3, wherein said rod forms a substantially right angle with said wrench arm, said angle being substantially independent of the variation in the distance between said one and said another threaded members.

* * * * *